US008647019B2

(12) United States Patent
Sintini et al.

(10) Patent No.: US 8,647,019 B2
(45) Date of Patent: Feb. 11, 2014

(54) FACILITY HAVING FANNED SEABED-TO-SURFACE CONNECTIONS

(75) Inventors: Gianluca Sintini, Paris (FR); Gianmarco Rota, Mozzo (IT); Floriano Casola, Gazzada Schianno (IT); Giulio Fatica, Milan (IT)

(73) Assignee: SAIPEM S.A., Montigny le Bretonneux (FR)

( * ) Notice: Subject to any disclaimer, the term of this patent is extended or adjusted under 35 U.S.C. 154(b) by 0 days.

(21) Appl. No.: 13/510,380

(22) PCT Filed: Oct. 15, 2010

(86) PCT No.: PCT/FR2010/052197

§ 371 (c)(1),
(2), (4) Date: May 17, 2012

(87) PCT Pub. No.: WO2011/061422

PCT Pub. Date: May 26, 2011

(65) Prior Publication Data

US 2012/0230770 A1 Sep. 13, 2012

(30) Foreign Application Priority Data

Nov. 17, 2009 (FR) ..... 09 58096

(51) Int. Cl.
*F16L 1/14* (2006.01)

(52) U.S. Cl.
USPC ..... 405/224.2; 405/169; 405/224.3; 166/350; 166/367

(58) Field of Classification Search
USPC ..... 405/169, 170, 171, 158, 224, 224.1, 405/224.2, 224.3; 166/344–347, 350–352, 166/366, 367, 378–380; 441/1, 32
See application file for complete search history.

(56) References Cited

U.S. PATENT DOCUMENTS

| | | | | |
|---|---|---|---|---|
| 4,182,584 | A * | 1/1980 | Panicker et al. | 405/224.3 |
| 4,762,180 | A * | 8/1988 | Wybro et al. | 166/350 |
| 5,275,510 | A * | 1/1994 | de Baan et al. | 405/171 |
| 5,480,264 | A * | 1/1996 | Hunter | 405/195.1 |
| 5,639,187 | A | 6/1997 | Mungall et al. | |
| 5,957,074 | A * | 9/1999 | de Baan et al. | 114/230.12 |
| 6,062,769 | A * | 5/2000 | Cunningham | 405/195.1 |
| 6,082,391 | A * | 7/2000 | Thiebaud et al. | 137/236.1 |

(Continued)

FOREIGN PATENT DOCUMENTS

| | | |
|---|---|---|
| FR | 2790054 | 8/2000 |
| FR | 2809136 | 11/2001 |

(Continued)

*Primary Examiner* — Thomas B Will
*Assistant Examiner* — Jessica H Lutz
(74) *Attorney, Agent, or Firm* — Cozen O'Connor

(57) ABSTRACT

An installation of bottom-to-surface connections having a plurality of bottom-to-surface connections arranged in a fan from a common floating support. The installation having a first number k of first bottom-to-surface connections, with each first number of connections having a first riser connected to a first undersea pipe tensioned in substantially vertical manner by a first float, and a diving first flexible connection pipe connecting the floating support and first riser. The installation further having a second number m of second bottom-to-surface connection, with each second number of connections having a second rigid pipe connected to a second undersea pipe and tensioned by a second buoyancy element, and a second flexible connection pipe providing the connection between the floating support and the second rigid pipe.

22 Claims, 4 Drawing Sheets

(56) References Cited

U.S. PATENT DOCUMENTS

| | | | | |
|---|---|---|---|---|
| 6,200,180 | B1 * | 3/2001 | Hooper | 441/5 |
| 6,415,828 | B1 | 7/2002 | Duggal et al. | |
| 6,688,348 | B2 | 2/2004 | Fontenot | |
| 6,725,936 | B2 * | 4/2004 | Hopper | 166/366 |
| 7,040,841 | B2 * | 5/2006 | Kelm et al. | 405/224.2 |
| 7,100,694 | B2 * | 9/2006 | Legras et al. | 166/350 |
| 7,434,624 | B2 * | 10/2008 | Wilson | 166/368 |
| 7,441,602 | B2 * | 10/2008 | Saint-Marcoux | 166/302 |
| 7,591,316 | B2 * | 9/2009 | Hatton | 166/355 |
| 7,958,938 | B2 * | 6/2011 | Crossley et al. | 166/366 |
| 2003/0161690 | A1 * | 8/2003 | Breivik et al. | 405/224.2 |
| 2004/0079530 | A1 * | 4/2004 | Ribeiro Lima et al. | 166/366 |
| 2005/0063788 | A1 * | 3/2005 | Clausen | 405/224.2 |
| 2006/0000615 | A1 * | 1/2006 | Choi | 166/352 |
| 2006/0056918 | A1 * | 3/2006 | Luppi | 405/169 |
| 2007/0081862 | A1 * | 4/2007 | Wolbers et al. | 405/169 |
| 2008/0311804 | A1 | 12/2008 | Dauduin et al. | |
| 2010/0018717 | A1 * | 1/2010 | Espinasse et al. | 166/346 |
| 2011/0017465 | A1 * | 1/2011 | Wales et al. | 166/339 |
| 2011/0083853 | A1 * | 4/2011 | Pionetti | 166/345 |
| 2012/0018165 | A1 * | 1/2012 | Crossley et al. | 166/344 |
| 2012/0292040 | A1 * | 11/2012 | Prescott | 166/345 |

FOREIGN PATENT DOCUMENTS

| | | | | | |
|---|---|---|---|---|---|
| FR | 2821143 | | | 8/2002 | |
| FR | 2826051 | | | 12/2002 | |
| FR | 2839110 | | | 10/2003 | |
| FR | 2890098 | | | 3/2007 | |
| FR | 2942497 | A1 | * | 8/2010 | E21B 17/01 |
| GB | 2191230 | A | * | 12/1987 | E21B 17/01 |
| GB | 2387635 | A | * | 10/2003 | F16L 1/12 |
| JP | 02214404 | A | * | 8/1990 | H02G 1/10 |
| WO | WO 00/08262 | | | 2/2000 | |
| WO | WO 2009/138609 | A2 | * | 11/2009 | E21B 17/01 |

* cited by examiner 4c-3
4b-3
4c-1
4b-1
4d-5
4d-1
12
L4
β
z
x
o
y
H
4c-1,4c3
5a
$\gamma_2<0$
4b-1,4b-3
4e-2
4e-3
5c
$R_0$
$R_2$
R1
$\gamma_1$
6
4-2
4c-2
4b-2
4a-2
4a-3
4a-1
3a-3
3c-3
3b-3
3e-3
3d-3
3-3
11
1
2
3c,3c-3
6,6c
6,6b
6,6a

FACILITY HAVING FANNED SEABED-TO-SURFACE CONNECTIONS

RELATED APPLICATIONS

This is a U.S. national stage of application No. PCT/FR2010/052197, filed on Oct. 15, 2010. Priority is claimed on the following application: French Application No.: 09 58096 filed on Nov. 17, 2009, the content of which is hereby incorporated here by reference.

FIELD OF THE INVENTION

The present invention relates to an installation of multiple bottom-to-surface connections between undersea pipes resting on the sea bottom and a support floating on the surface, the installation comprising a multiplicity of hybrid towers each made up of a flexible pipe connected to a rising rigid pipe, or vertical "riser", having its bottom end secured to an anchor device comprising a base resting on the sea bottom.

The technical sector of the invention relates more particularly to the domain of making and installing production risers for undersea extraction of oil, gas, or other soluble or meltable material, or a suspension of mineral matter, from an undersea well head up to a floating support in order to develop production fields at sea, off shore. The main and immediate application of the invention lies in the domain of oil production.

BACKGROUND OF THE INVENTION

In general, the floating support has anchor means enabling it to remain in position in spite of the effects of currents, winds, and swell. It also generally includes means for storing and processing oil and means for discharging to off-loading tankers, which call at regular intervals in order to take away the production. These floating supports are commonly referred to as floating production storage off-loading supports with the abbreviation "FPSO" being used throughout the description below.

Bottom-to-surface connections are known for an undersea pipe resting on the sea bottom, the connection being of the hybrid power type and comprising:

- a vertical riser having its bottom end anchored to the sea bottom via a flexible hinge and connected to a said pipe resting on the sea bottom, with its top end tensioned by a sub-surface float to which it is connected; and
- a connection pipe, in general a flexible connection pipe, between the top end of said riser and a floating support on the surface, and, where appropriate, said flexible connection pipe under the effect of its own weight taking up the shape of a diving catenary curve, i.e. going down well below the float before rising again up to the floating support.

Bottom-to-surface connections are also known that are made by continuously raising up to the sub-surface strong and rigid pipes constituted by thick steel tubular elements that are welded or screwed together and that take up a catenary configuration of continuously varying curvature all along their suspended length, commonly referred to as steel catenary risers (SCRs) and also commonly referred to as rigid catenary risers.

Such a catenary pipe may rise up to the support floating on the surface, or it may rise no further than a sub-surface float that tensions its top end, which top end is then connected to a floating support by a diving flexible connection pipe. Catenary risers of reinforced configuration are described in WO 03/102350 in the name of the Applicant.

In WO 00/49267, SCR rigid pipes are proposed as connection pipes between the floating support and the riser having its top tensioned by a float immersed below the surface, and the float is installed at the head of the riser at a greater distance from the surface, in particular at least 300 meters (m) from the surface, and preferably at least 500 m.

WO 00/49267, in the name of the Applicant, describes a multiple hybrid tower including an anchor system with a vertical tendon constituted either by a cable or by a metal bar or even by a pipe that is tensioned at its top end by a float. The bottom end of the tendon is fastened to a base resting on the bottom. Said tendon includes guide means distributed along its entire length with a plurality of said vertical risers passing therethrough. Said base may merely be placed on the sea bottom and remain in place under its own weight, or it may be anchored by means of piles or any other device suitable for keeping it in place. In WO 00/49267, the bottom end of the vertical riser is suitable for being connected to the end of a bent sleeve that is movable relative to said base between a high position and a low position, said sleeve being suspended from the base and being associated with return means that urge it towards a high position in the absence of a riser. This ability of the bent sleeve to move enables variations in riser length under the effects of temperature and pressure to be absorbed. At the head of the vertical riser, an abutment device secured thereto bears against the support guide installed at the head of the float and thus keeps the entire riser in suspension.

The connection with the undersea pipe resting on the sea bottom is generally provided via a portion of pipe having a pigtail shape or an S-shape, said S-shape being made in a plane that is either vertical plane or horizontal plane, the connection with said undersea pipe generally being made via an automatic connector.

Thus, a wide variety of bottom-to-surface connections are in existence that enable undersea well heads to be connected to a floating support of the FPSO type, and in certain oil field developments, a plurality of well heads are connected in parallel to a common bottom-to-surface connection so as to limit the extent to which the side of the FPSO is occupied, since each of said bottom-to-surface connections must be spaced apart from its immediate neighbors so as to avoid any interference and any impacts, not only between the floats, but also between the flexible pipes and electric cables connecting with said FPSO.

In certain oil field developments, it is necessary to connect each of the well heads individually to a said FPSO, and there are thus very many bottom-to-surface connections and it is not possible to install all of them because the length of the side of the FPSO is limited and can accept only a limited number of bottom-to-surface connections.

It is desired to use as many bottom-to-surface connections as possible from a single floating support in order to optimize the exploitation of oil fields. That is why various systems have been proposed for enabling a plurality of vertical risers to be associated together in order to reduce the size of the exploitation fields and in order to be able to use as many bottom-to-surface connections as possible connected to a common floating support. Typically, it is necessary to make provision for installing up to 30 or even 40 bottom-to-surface connections from a common floating support.

WO 00/49267 describes a multiple hybrid tower including an anchor system with a vertical tendon constituted either by a cable or by a metal bar or even by a pipe that is tensioned at its top end by a float. The bottom end of the tendon is fastened to a base resting on the bottom. Said tendon includes guide means distributed along its entire length with a plurality of said vertical risers passing therethrough. Said base may be merely placed on the sea bottom and remain in place under its own weight, or it may be anchored by means of piles or any other device suitable for keeping it in place. In WO 00/49267, the bottom end of the vertical riser is suitable for being connected to the end of a bent sleeve that is movable relative to said base between a high position and a low position, said sleeve being suspended from the base and being associated with return means that urge it towards a high position in the absence of the riser. This ability of the bent sleeve to move enables variations in riser length under the effects of temperature and pressure to be absorbed. At the head of the vertical riser, an abutment device secured thereto bears against the support guide installed at the head of the float and thus keeps the entire riser in suspension.

The connection with the undersea pipe resting on the sea bottom is generally provided via a portion of pipe having a pigtail shape or an S-shape, said S-shape then being made in a plane that is either vertical or horizontal, the connection with said undersea pipe generally being made via an automatic connector.

That embodiment comprising a multiplicity of vertical risers held by a central structure having guide means is relatively expensive and complex to install. Furthermore, the installation needs to be prefabricated on land prior to being towed out to sea, and then once on site up-ended in order to be put into place. In addition, maintenance thereof also requires relatively high operating costs.

In WO 02/66786 and WO 02/103153, in the name of the Applicant, multiple-riser hybrid towers are described having vertical riser anchor systems suitable for receiving two risers side by side from a common anchor base, with the floats at the heads of said risers being fastened and secured to each other by means of a hinged parallelogram structure. The two risers are also connected together by tubular collars fastened to one of the risers and connected by rings that slide freely around the second riser, such that the two risers can follow substantially the same lateral movements while being relatively more independent of each other in their vertical movements.

When it is desired to associate a plurality of risers with a common floating support, the problem arises of interface between the movements of said risers that are subjected to the same movement as their tensioning float at the top under the effect of movements of the floating support at the surface, which is subjected to swell, wind, and current.

When a multiplicity of bottom-to-surface connections of the hybrid tower type are implemented, each comprising a single vertical riser, it is necessary in practice for the various connections to be spaced apart from one another, for at least the following two reasons:

1) all of the respective bases of the two hybrid towers when anchored via suction anchors anchored to the sea bottom must be spaced apart by distances of not less than five times and preferably at least ten times the diameter of said anchors in order to avoid interference in terms of secure connection to the sea bottom and in order to guarantee reliable anchoring; and 2) secondly, the floats at the tops of the risers are subjected to movements within a cone having its apex situated at the anchor system, and of an angle that makes it necessary to provide sufficient distance between the various floats at the tops of the vertical risers in order to prevent them from striking against one another.

Those constraints involve spreading out the exploitation zone and limiting the number of bottom-to-surface connections that can be connected to a common floating support, via the sides thereof, in order to avoid interference between the various connections.

Furthermore, since the crude oil is conveyed over very long distances, i.e. several kilometers, it is necessary to provide an extremely expensive level of insulation, firstly to minimize any increase in viscosity that would lead to a drop in the hourly production rate from the wells, and secondly to avoid the flow becoming blocked by paraffin being deposited or by hydrates forming when the temperature drops to around 30° C. to 40° C. These phenomena are critical because the temperature at the bottom of the sea is about 4° C. and, particularly in West Africa, the crude oils are of the paraffin type. It is therefore desirable for bottom-to-surface connections to be short in length and thus for the space occupied by the various connections to a common floating support to be limited.

That is why it is desirable to provide an installation suitable for enabling a common floating support to operate a plurality of hybrid tower type bottom-to-surface connections that occupy a limited amount of space with limited movement, and that are also simple to lay, with it being possible for them to be fabricated at sea on board a pipe-laying ship, in order to avoid prefabrication on land followed by towing out to site and upending in order to put the installation finally into place.

SUMMARY OF THE INVENTION

An object of the present invention is thus to provide an installation with a large quantity of multiple bottom-to-surface connections of a variety of types beside an FPSO, enabling a plurality of well heads and undersea installations installed on the sea bottom at great depth, i.e. in depths of more than 1000 m of water, to be connected and preferably connected individually.

Still more particularly, the problem posed in the present invention is thus to provide an installation with a multiplicity of bottom-to-surface connections from a common floating support, and in which the methods of laying and putting the installation into place make it possible simultaneously:

- to reduce the positioning distance between the various bottom-to-surface connections, i.e. to enable a plurality of bottom-to-surface connections to be installed in a space that is as small as possible, or in other words to occupy a reduced area on the sea bottom, with this being for the purpose, amongst others, of increasing the number of bottom-to-surface connections that can be installed on the side of an FPSO without said bottom-to-surface connections interfering with one another; and
- to fabricate and install easily by fabricating and laying sequentially the various pipes from a surface laying ship fitted with a J-lay tower; and finally
- to optimize the use of buoyancy means when installation is spread out over a long period of time between installing the various bottom-to-surface connections, and with this being possible without it being necessary to know from the beginning how many connections are going to be laid, nor their characteristics in terms of dimensions and unit weight.

During the stage of planning the development of an oil field, the oil reservoir is known only incompletely, and once production is at full speed, it is often necessary, a few years later, to reconsider the initial production plans and the associated organization of equipment. Thus, during initial installation of the system, the number of bottom-to-surface connections and the way they are organized is defined relative to estimated requirements, which requirements are almost always upgraded once the field is in production, either for the purpose of recovering crude oil or because of the need to inject more water into the reservoir, or indeed for the purpose of recovering or reinjecting more gas. As the reservoir becomes exhausted, it generally becomes necessary to drill new wells in order to reinject water or gas, or indeed to drill production wells at new locations in the field, so as to increase the overall recovery rate, thereby correspondingly complicating the set of the bottom-to-surface connections connected to the side of the FPSO.

Another problem that arises in the present invention is to be able to make and install such bottom-to-surface connections for undersea pipes at great depths, such as deeper than 1000 m, for example, and of the type comprising a vertical hybrid tower, where the fluid being transported needs to be maintained above some minimum temperature until it reaches the surface, by minimizing components that are the subject of heat losses, by avoiding drawbacks associated with the thermal expansion of the various components of said tower, individually or differentially, so as to withstand the extreme stresses and fatigue phenomena that can accumulate over the lifetime of the installation, which lifetime commonly exceeded 20 years.

Another problem of the present invention is also to provide an installation of multiple bottom-to-surface connections using hybrid towers in which the anchoring system is very strong and is also inexpensive, and in which the method for fabricating and installing the various elements making up the installation are simplified and also of low cost, and suitable for being implemented at sea from a laying vessel.

To do this, the present invention provides an installation of bottom-to-surface connections, the installation comprising a plurality of bottom-to-surface connections arranged in a fan from a common floating support to a plurality of undersea pipes resting on the sea bottom, said bottom-to-surface connections comprising at least:

1) a first number k of at least 2 and preferably 5 to 50, more preferably at least 10, first bottom-to-surface connections, each referred to as a first bottom-to-surface connection and forming a first hybrid tower, each comprising:

1a) a first rigid pipe consisting in a first vertical riser having its bottom end fastened to a first base anchored to the sea bottom and connected to a first undersea pipe resting on the sea bottom, and with its top end tensioned in substantially vertical manner by a first float that is immersed in the subsurface, preferably at a depth of at least 100 m, to which the first pipe is connected; and 1b) a diving first flexible connection pipe providing the connection between said floating support and the top end of said first riser, said first flexible pipe being attached at the level of a side of said floating support, two successive attachment points of said first flexible pipe being spaced apart from each other, the various ones of said first flexible pipes preferably being regularly spaced apart by the same distance, and two virtual vertical planes containing respectively two of said successive first flexible connections pipes at rest, being arranged angularly relative to each other at a first angle $\alpha i$ with i=1 to k, the various vertical planes of the various ones of said first flexible connection pipes intersecting substantially at a common point $C_0$ in a horizontal section plane, the various angles $\alpha i$ preferably all having the same value; and 2) a second number m of at least one second bottom-to-surface connection, each second bottom-to-surface connection forming a second hybrid tower comprising:

2a) a second rigid pipe consisting in a rising column comprising a second vertical riser or an SCR type catenary second rigid pipe, with the bottom end thereof connected to a second undersea pipe resting on the sea bottom and with the top end tensioned by a second buoyancy element immersed in the subsurface preferably at a depth of at least 50 m, to which the second pipe is connected; and 2b) a second flexible connection pipe providing the connection between said floating support and the top end of said second rigid pipe, each of said second flexible pipes passing via a trough fastened to a said first float, thereby defining two diving portions of second flexible pipe on respective sides of said first float, the attachment point of each said second flexible pipe on said side being situated in the proximity of and preferably juxtaposed against the attachment point of said first flexible connection pipe with said first float supporting said second flexible pipe.

Preferably, the installation of bottom-to-surface connections of the invention comprises:

at least 2, preferably 5 to 50, more preferably at least 10, of said second bottom-to-surface connections; and the shortest distance between an attachment point of a said second flexible pipe on the floating support and the top end of said second rigid pipe to which it is connected is greater than the longest distance between an attachment point of a said first flexible pipe on the floating support and the top end of said first rigid pipe to which it is connected.

The term "attachment point of the second flexible pipe situated close to the attachment point to the flexible pipe" means that the distance between the attachment point of the second flexible pipe and the attachment point of the first flexible pipe is less than the distance between two successive attachment points of two first flexible pipes attached in succession to the side of the floating support.

It can be understood that said first floats, said first rigid pipes, and said first flexible pipes are of dimensions in terms of buoyancy and of the developed lengths of the flexible pipes, and are positioned relative to one another, in such a manner that said first angles $\alpha i-1$ and $\alpha i$ with i=2 to k are greater than the second angles $\alpha' i$ through which said first floats or said top ends of said respective first rigid pipes can move angularly in the event of movements of the sea due to currents, waves, or swell, with the angle of angular movements $\alpha' i$ being an angle at the same apex $C_0$ as the first angles $\alpha i$ and being such that the bisector of $\alpha' i$ is contained in said vertical plane Pi of said respective first flexible pipe.

In practice, by spacing the attachment points of said first flexible pipes apart in a fan configuration, corridors are created that form angular sectors within which the various elements of the first bottom-to-surface connection and of the second bottom-to-surface connection do not run the risk of striking against the elements of another said first bottom-to-surface connection and/or another said second bottom-to-surface connection.

The present invention is particularly advantageous in that it makes it possible to take advantage of the installation of said first float to act as intermediate supports for said second flexible pipes that are longer than said first flexible pipes, and thereby reduce the horizontal tension that is generated by said second flexible pipe at the top end of said second rigid pipe, and to do so without significantly increasing the horizontal tensions at said first floats, since these tensions balance out. The horizontal tensions generated by said flexible pipes at the top ends of the rigid pipes and at the floats to which they are connected give rise to movements, surging, and lateral displacements of said top ends of the rigid pipes, in rough sea.

In this context, it should be recalled that the essential function of diving flexible pipes is to absorb at least some of the movements of the top ends of the rigid pipes to which one of their ends is connected and/or the movements of the floating support to which their other end is connected by mechanically decoupling the respective movements of the top ends of the rigid pipes to which they are connected and of the floating supports to which they are also connected via their other ends.

Another advantage of this type of installation is that:

- it can accommodate greater lateral displacement of the top ends of said second rigid pipes, given that they are further away from the floating supports than the top ends of said first rigid pipes; and/or
- it enables a plurality of second rigid pipes to be used that are connected to a plurality of second flexible pipes that are all fastened to a common first float.

It can be understood that the first portions of said second flexible pipes extending between the floating support and said first float are situated above said first flexible pipes insofar as said first float is situated above the top end of said first rigid pipe to which one end of said first flexible pipe is connected.

In known manner, a said flexible connection pipe takes up a diving catenary curve shape under the effect of its own weight, i.e. it goes down well below its attachment point at each of its ends, respectively with the floating support and with the top end of the rigid pipe to which it is connected, providing the length of said flexible pipe is greater than the distance between its attachment point to the floating support and the top end of said rigid pipe to which it is connected.

Advantageously, said first float, and preferably each said first float, supports at least two of said second flexible pipes, preferably passing respectively via at least two said troughs fastened to a common said first float.

Advantageously, said second rigid pipe consists in a second vertical riser having its bottom end fastened to a second base anchored to the sea bottom and connected to a said second undersea pipe resting on the sea bottom and having its top end tensioned in substantially vertical manner by a second float immersed in the subsurface, preferably at a depth of at least 50 m, to which the second pipe is connected.

Preferably, the distance between the floating support and the nearest of said second bases is greater than the distance between said floating support and the farthest of said first bases.

Advantageously, said first floats are not situated at equal distances from a common flat side of said floating support to which said first flexible pipes are connected; and preferably, said first floats are all situated at the same distance $L_1$ from the point of intersection $C_0$ of said vertical planes Pi of said first flexible pipes attached to a common side of said floating support, thereby forming a first circular row $R_1$ of said first floats.

It can be understood that if said first floats are not all situated at substantially the same distance from said point of intersection $C_0$ situated beyond the side of said first floating support, that means that said first floats are not mutually in alignment in a rectilinear row parallel to said flat side.

Preferably, a plurality of said second floats, preferably at least a majority of said second floats, are situated at substantially the same distance $L_2$ from the point of intersection $C_0$ of said vertical planes Pi of said first flexible pipes attached to a common side of said floating support and with which said second floats are in connection, thereby forming a second circular row $R_2$ of said second floats.

It can be understood that if said first floats and/or said second floats are arranged in an order, in particular on a circular row, then said corresponding respective first bases and/or second bases are also arranged in the same order, in particular along a circular row, where appropriate.

The terms "second flexible pipe in connection with a second float" or "second flexible pipe in connection with a second base" are used herein to mean that said second flexible pipe and said second float or respectively said second base belong to a common second bottom-to-surface connection.

Also preferably, the various ones of said second floats in connection with a common said first float are not all situated at the same distance from said first float, and the various ones of said bases in connection with a common said first float are not all situated at the same distance from the attachment point on the floating support of said corresponding second bottom-to-surface connections.

The term "second float or second base in connection with a common first float" is used herein to mean that said second bottom-to-surface connections including said second floats and/or said second bases have said second flexible pipes supported by a common said first float.

Also preferably, said second floats form at least one second circular row $R_2$ of second floats and a third circular row $R'_2$ of second floats that is further away $L'_2$ than said second circular row of second floats.

It can be understood that in the same manner, said second bases form at least one second circular row of said second bases and a third circular row of said second bases further away from the floating support than said second circular row of second bases.

Also advantageously, at least two of said second flexible pipes passing via a common said first float are fastened to troughs arranged at different heights on said first floats.

It can be understood that this arrangement serves to avoid interference between two relatively close flexible pipes in the event of rough weather.

Also advantageously, at least two of said second flexible pipes passing via a common said first float are fastened to troughs arranged on opposite faces of said first float.

More particularly, an installation of the invention also includes at least an $n^{th}$ bottom-to-surface connection, where n is an integer not less than 3, the installation comprising:

a) an $n^{th}$ rigid pipe consisting in a rising column comprising an $n^{th}$ vertical riser or an $n^{th}$ SCR type catenary rigid pipe having its bottom end connected to an $n^{th}$ undersea pipe resting on the sea bottom and having its top end tensioned by an $n^{th}$ buoyancy element immersed in the subsurface, preferably a terminal $n^{th}$ float immersed at a depth of at least 100 m, to which the $n^{th}$ pipe is connected; and b) an $n^{th}$ flexible connection pipe providing the connection between the floating support and the top end of said $n^{th}$ rigid pipe, each said $n^{th}$ flexible pipe passing via n−1 troughs fastened respectively to n−1 intermediate floats immersed in the subsurface, thereby defining n diving portions of said $n^{th}$ flexible pipes, each of said n−1 intermediate floats preferably being a float tensioning at least one and preferably all of the $(n-1)^{th}$ rigid pipes of respective $(n-1)^{th}$ bottom-to-surface connections.

It can be understood that the bottom-to-surface connection of order n−1 corresponds to said first bottom-to-surface connection and the bottom-to-surface connection of order n−1 corresponds to an $(n-1)^{th}$ bottom-to-surface connection.

In a particular embodiment, a said second or $n^{th}$ rigid pipe, where n is an integer not less than 3, is a catenary type pipe constituted by the end of a second or $n^{th}$ undersea pipe respectively resting on the sea bottom and rising to the subsurface along a catenary curve, essentially a continuously varying curve up to a respective said second or $n^{th}$ terminal float.

Preferably, said second or $n^{th}$ terminal float at the top of a said second or $n^{th}$ rigid pipe of catenary type is secured to and rigidly fastened to at least one other said second or $n^{th}$ float in connection with a respective said second or $n^{th}$ vertical riser, the various respective second or $n^{th}$ terminal floats that are rigidly fastened together being in connection with the same said first float or with the same n−1 said intermediate floats.

The term "rigidly fastened" is used herein to mean that said two second floats are secured to each other for the purposes of moving by means of a rigid connection, and in particular that any degree of freedom to move in rotation or in translation of one of said second floats relative to the other one is eliminated as though they were restrained relative to each other.

The installation of the present invention thus presents overall size and movements that are reduced and stability that is increased, as described in WO 2007/023233.

By arranging two said second rigid pipes constituted by two said second vertical risers, each with a said second float specific thereto at the top of independent anchor points, so that they co-operate with each other, this system makes it possible firstly to build the entire installation at sea from a laying and operating vessel while simplifying laying of the respective risers at sea, and secondly gives them stability in operation as a result of their floats being fastened together, with identical movements of the top ends and of the second floats, with the minimum spacing complied with for the bearing points on the sea bottom or second bases, although small, nevertheless contributing to stabilizing the movements at the heads of the second risers.

This enables the two second floats to be brought close together without collisions between the two second floats in any of their respective movements.

Preferably, and more particularly; at least two of said respective second or $n^{th}$ floats that are associated with a common first float are fastened rigidly to each other and to corresponding respective second or $n^{th}$ bases that are connected respectively with the two said terminal second or $n^{th}$ floats being spaced from each other by a distance that is sufficient to ensure that the anchoring is reliable, in particular a distance of at least five times and preferably at least ten times the diameter of said anchors.

Preferably, said second bases that are closest together are spaced apart by a distance of at most 50 m, and preferably lying in the range 25 m to 50 m.

More particularly, said bases include suction anchors embedded in the sea bottom.

Thus, the two second vertical risers are connected together at their top ends, but they have different anchor points that are spaced apart from each other, such that in the event of differential expansion due to different temperatures within each of the two vertical risers, the triangular shape becomes deformed, where the apex of the triangular shape is constituted by the set of two second floats and where its base is constituted by the substantially horizontal straight line interconnecting the two said second bases.

In an embodiment, the installation of bottom-to-surface connections of the invention includes a said second rigid pipe of the catenary type that is constituted by the end of one of said second undersea pipes resting on the sea bottom and rising up to the subsurface along a catenary curve, essentially along a curve that varies continuously, up to a said second float. In this embodiment, the bearing and contact point from which said second catenary pipe (or SCR) rises to the subsurface from the sea bottom varies substantially depending on the movements of the top portion of said catenary, and this serves to stabilize the base of said catenary in a limited zone, which thus acts as a second base.

In this embodiment, and preferably, said second float of the top of said second rigid pipe in the form of a catenary or SCR is secured and rigidly fastened to another second float in connection with another second rigid pipe, but that is of the vertical riser type, with the various second floats that are rigidly fastened to one another being in connection with a common said first float.

In this embodiment, it is said second vertical riser that stabilizes said second rigid pipe of SCR type without any need for the top of said SCR type pipe being stabilized by a cable or line anchored to the sea bottom.

In a preferred embodiment, said second floats are fastened to one another by fastener means situated at two points on each second float, the two points being vertically spaced apart so as to cause the respective movements of the two second floats to take place together, preferably by using fastener means situated at two points that are close respectively to the top and bottom ends of the cylindrical vessels constituting said second floats.

Also advantageously, the at least two said floats that are fastened together are inserted within a peripheral shield of streamlined shape, preferably of cylindrical shape.

In order to connect the flexible pipes to said rigid pipes or risers, swan-neck-type devices that are known to the person skilled in the art are interposed between them, with an improved example of such a device being described in FR 2 809 136 in the name of the Applicant.

In an advantageous variant embodiment, the anchor points of said second flexible connection pipes with the top ends of the respective second rigid pipes are situated at different depths, and preferably said second flexible connection pipes present lengths and curves that are different.

This configuration thus makes it possible to avoid any impact between the second flexible connection pipes when they are caused to move under the effect of swell, current, and/or movements of the floating support.

In another variant embodiment, the attachment points of said second flexible connection pipes to the respective top ends of the vertical risers or rigid pipes of SCR type are at substantially the same depth and the second flexible pipes are of substantially the same length and of substantially the same curvature, being connected to each other so as to be secured substantially to each other so that, where appropriate, they are subjected to movements that are synchronous, thereby avoiding any interference or impact between the second flexible pipes as a result of movements associated with swell, currents, and/or movements of the floating support.

In an embodiment, an installation of the invention is characterized in that:

one end of a second or $n^{th}$ flexible pipe is directly connected, preferably by a system of flanges, to the top end of a second or $n^{th}$ vertical riser, respectively; and the bottom end of the second or $n^{th}$ vertical riser includes a terminal pipe element forming an inertia transition piece in which the variation of inertia is such that the inertia of said terminal pipe element at its top end is substantially identical to the inertia of the pipe element constituting the main portion of the second vertical riser to which it is connected, said inertia of the terminal pipe element increasing progressively to the bottom end of said inertia transition piece having a first fastener flange enabling the bottom end of said second or $n^{th}$ vertical riser, respectively, to be fastened to and restrained by a support and connection device secured to said second or $n^{th}$ base, respectively, anchored to the sea bottom; and a terminal portion of said second or $n^{th}$ flexible pipe, respectively, beside its junction with the top end of said second or $n^{th}$ riser, respectively, presents positive buoyancy, and at least a top portion of the second or $n^{th}$ vertical riser also presents positive buoyancy, such that the positive buoyancies of said terminal portion of said second or $n^{th}$ flexible pipe and of said top portion of said second or $n^{th}$ vertical riser enable said second or $n^{th}$ riser to be tensioned in a substantially vertical position and enable the end of said terminal portion of said second or $n^{th}$ pipe to be in alignment with or in continuity of curvature with the top portion of said second or $n^{th}$ vertical riser where they are connected together, said positive buoyancy being provided by a plurality of peripheral floats arranged coaxially around the pipe and regularly spaced therealong, and/or by a continuous coating of positive buoyancy material; and said terminal portion of said second or $n^{th}$ flexible pipe presenting positive buoyancy extends over a fraction of the total length of said second or $n^{th}$ flexible pipe, such that the portion of said second pipe that extends between said first or $(n-1)^{th}$ float, respectively, and the top of said second or $n^{th}$ vertical riser, respectively, presents an S-shaped configuration, with a portion beside said first or $(n-1)^{th}$ float presenting concave curvature in the form of a catenary having a diving catenary configuration, and the remaining terminal portion of said second flexible pipe presenting convex curvature of upside-down catenary shape as a result of its positive buoyancy, the end of said terminal portion of said second or $n^{th}$ flexible pipe, respectively, at the top end of said second or $n^{th}$ riser, respectively, being preferably situated above and substantially in alignment with the sloping axis $Z_1Z'_1$ of said second riser at its top end.

The term "vertical riser" is used herein to designate the theoretical substantially vertical position for the second or $n^{th}$ riser when it is at rest, it being understood that the axis of the second or $n^{th}$ riser may be subjected to angular movements relative to the vertical and that it may move within a cone of angle $\gamma_2$ at the vertex that corresponds to the point at which the bottom end of the second or $n^{th}$ riser is fastened to said base. The top end of said second or $n^{th}$ vertical riser may be slightly curved. Thus, the term "terminal portion of the second or $n^{th}$ flexible pipe substantially in alignment with the axis $Z_1Z'_1$ of said second or $n^{th}$ top riser" should be understood as meaning that the end of the upside-down catenary curve of said second or $n^{th}$ flexible pipe is substantially tangential to the end of said second or $n^{th}$ vertical riser. In any event, it should be in continuity of curvature variation, i.e. without any point that is singular in the mathematical meaning.

The term "inertia" is used herein to mean the second moment of area of said inertia transition pipe about an axis perpendicular to the axis of said inertia transition pipe element, thus representing the bending stiffness in each of the planes perpendicular to the axis of symmetry XX' of said pipe element, said second moment of area being proportional to the product of the section of material multiplied by the square of its distance from said axis of the pipe element.

The term "continuity of curvature" between the top end of the second vertical riser and the portion of the second flexible pipe presenting positive buoyancy means that said variation in curvature does not present any singularity, such as a sudden change of the angle of inclination of its tangent or a point of inflection.

Preferably, the slope of the curve formed by the second or $n^{th}$ flexible pipe is such that the inclination of its tangent relative to the axis $Z_1Z'_1$ of the top portion of said second or $n^{th}$ vertical riser increases continuously and progressively from the point of connection between the top end of the second or $n^{th}$ vertical riser and the end of said terminal portion of positive buoyancy of the second or $n^{th}$ flexible pipe, without any point of inflection and without any point of curvature reversal.

The installation of the present invention thus makes it possible to avoid tensioning the second or $n^{th}$ vertical riser with a second or $n^{th}$ surface or sub-surface float from which the top end of the riser is suspended, and also makes it possible to avoid the connection to said second or $n^{th}$ diving flexible pipe being made via a swan-neck type device. This results not only in greater intrinsic reliability in terms of mechanical strength over time for the connection between the second or $n^{th}$ vertical riser and the second or $n^{th}$ flexible pipe, given that swan-neck type devices are fragile, but also, and above all, in an installation that provides greater stability in terms of the angular variation ($\gamma_2$) in the angle of excursion of the top end of the second or $n^{th}$ vertical riser relative to an ideal rest position that is vertical, since, in practice, said angular variation is reduced to a maximum angle that does not exceed 5°, and in practice is about 1° to 4° in an installation of the invention, whereas in embodiments of the prior art, the angular excursion may be as much as 5° to 10°, or even more.

Another advantage of the present invention lies in that because this angular variation of the top end of the second or $n^{th}$ vertical riser is small, it is possible at its bottom end to make use of a rigid restrained connection on a second or $n^{th}$ base resting on the sea bottom without having recourse to an inertia transition piece of dimensions that are excessive and thus too expensive. It is thus possible to avoid implementing a flexible hinge, in particular of the flexible ball joint type, on condition that the junction between the bottom end of the second or $n^{th}$ riser and said restrained connection includes an inertia transition piece.

The positive buoyancies of the second or $n^{th}$ riser and of the second or $n^{th}$ flexible pipe may be provided in known manner by peripheral floats surrounding said pipes coaxially, or preferably, for the second or $n^{th}$ rigid pipe of the vertical riser, a coating of positive buoyancy material, preferably also constituting a lagging material, such as syntactic foam, in the foam of a shell in which said pipe is wrapped. Such buoyancy elements that are capable of withstanding very high pressures, i.e. pressures of about 10 megapascals (MPa) per 1000 m of depth of water, are known to the person skilled in the art and are available from the supplier Balmoral (UK).

More particularly, the positive buoyancy is distributed regularly and uniformly over all of the length of said terminal portion 10*a* of the second or $n^{th}$ flexible pipe and over at least the top portion 9*b* of said second or $n^{th}$ rigid pipe.

Preferably, in order to give maximum flexibility to the overall bottom-to-surface connection, said terminal portion of the second or $n^{th}$ flexible pipe presents positive buoyancy that extends over a length corresponding to 30% to 60% of the length of the portion of the second or $n^{th}$ flexible pipe that extends between the first float and the top end of the second or $n^{th}$ vertical riser, and preferably over about half of said length of the portion of the second or $n^{th}$ flexible pipe.

More particularly, in order to give the bottom-to-surface connection assembly appropriate flexibility, said positive buoyancy exerted on the terminal portion of the second or $n^{th}$ flexible pipe and on at least the top portion of said second or $n^{th}$ riser should exert vertical tension on the foundation of the second base at the bottom end of said second or $n^{th}$ rigid pipe that is a function of the depth of the water in application of the following formula: F=kH, where F is said vertical tension expressed in (metric) tonnes, H being said depth expressed in meters, k being a factor lying in the range 0.15 to 0.05, and preferably being equal to about 0.1.

If the overall positive buoyancy is distributed uniformly and regularly over the entire length of the second or $n^{th}$ rigid pipe and over a said terminal portion of the second or $n^{th}$ flexible pipe, said positive buoyancy should make it possible to obtain a resulting vertical thrust of 50 kilograms per meter (kg/m) to 150 kg/m, i.e. said required buoyancy should correspond to the apparent weight of said second or $n^{th}$ rigid pipe and of said terminal portion of the second or $n^{th}$ flexible pipe plus additional buoyancy in the range 50 kg/m to 150 kg/m.

Still more particularly, an installation of the invention is characterized in that:

said second or $n^{th}$ vertical riser, respectively, is connected at its bottom end to at least one second or $n^{th}$ undersea pipe, respectively, resting on the sea bottom; and said second or $n^{th}$ undersea pipe resting on the sea bottom has a terminal first bent rigid pipe element secured to said second or $n^{th}$ base resting on the sea bottom, and said terminal first bent rigid pipe element is held stationary relative to said second or $n^{th}$ base with, at its end, a first coupling element portion, preferably a male or female element of an automatic connector; and said first fastening flange at the bottom end of said inertial transition piece is fastened to a second fastener flange at the end of a second bent rigid pipe element secured to said support and connection device fastened on said second or $n^{th}$ base and supporting, in stationary and rigid manner, said second bent rigid pipe element, the other end of which includes a second coupling element portion complementary to said first coupling element portion and connected thereto when said support and connection device is fastened to said base.

It can be understood that the static geometry of said first rigid pipe element terminating said second or $n^{th}$ undersea pipe resting on the sea bottom, relative to said second or $n^{th}$ base, and the static geometry of said first and second base rigid pipe elements, relative to said support and connection device fastened to said second base, make it possible for the respective ends of said first and second rigid pipe elements to be positioned in such a manner as to facilitate connecting together the complementary automatic connector portions once the support and connection device is fastened to said base.

In this embodiment, said first terminal pipe element of said pipe resting on the sea bottom may preferably also be bent so as to coincide with the end of said second bent rigid pipe element, thereby making connection easy when using an undersea autonomous vehicle of the remotely operated vehicle (ROV) type at the sea bottom.

According to a more particular aspect, the present invention provides a method of exploiting an oil field using at least one installation of the invention, wherein fluids are transferred between a floating support and undersea pipes resting on the sea bottom, said fluids comprising oil, the invention preferably using a plurality of said installations, in particular three to 20 of said installations of the invention also connected to a common floating support.

In known manner, in order to connect the various pipes together use is made of connection elements, in particular of the automatic connector type, comprising mutual locking of a male portion and a complementary female portion, the locking being designed to be performed very simply at the bottom of the sea with the help of an ROV, a robot that is controlled from the surface, and without requiring direct manual action by personnel.

BRIEF DESCRIPTION OF THE DRAWINGS

Other characteristics and advantages of the present invention appear in the light of the following detailed description given with reference to the accompanying figures, in which.

DETAILED DESCRIPTION OF THE PRESENTLY PREFERRED EMBODIMENTS

Figure 1:
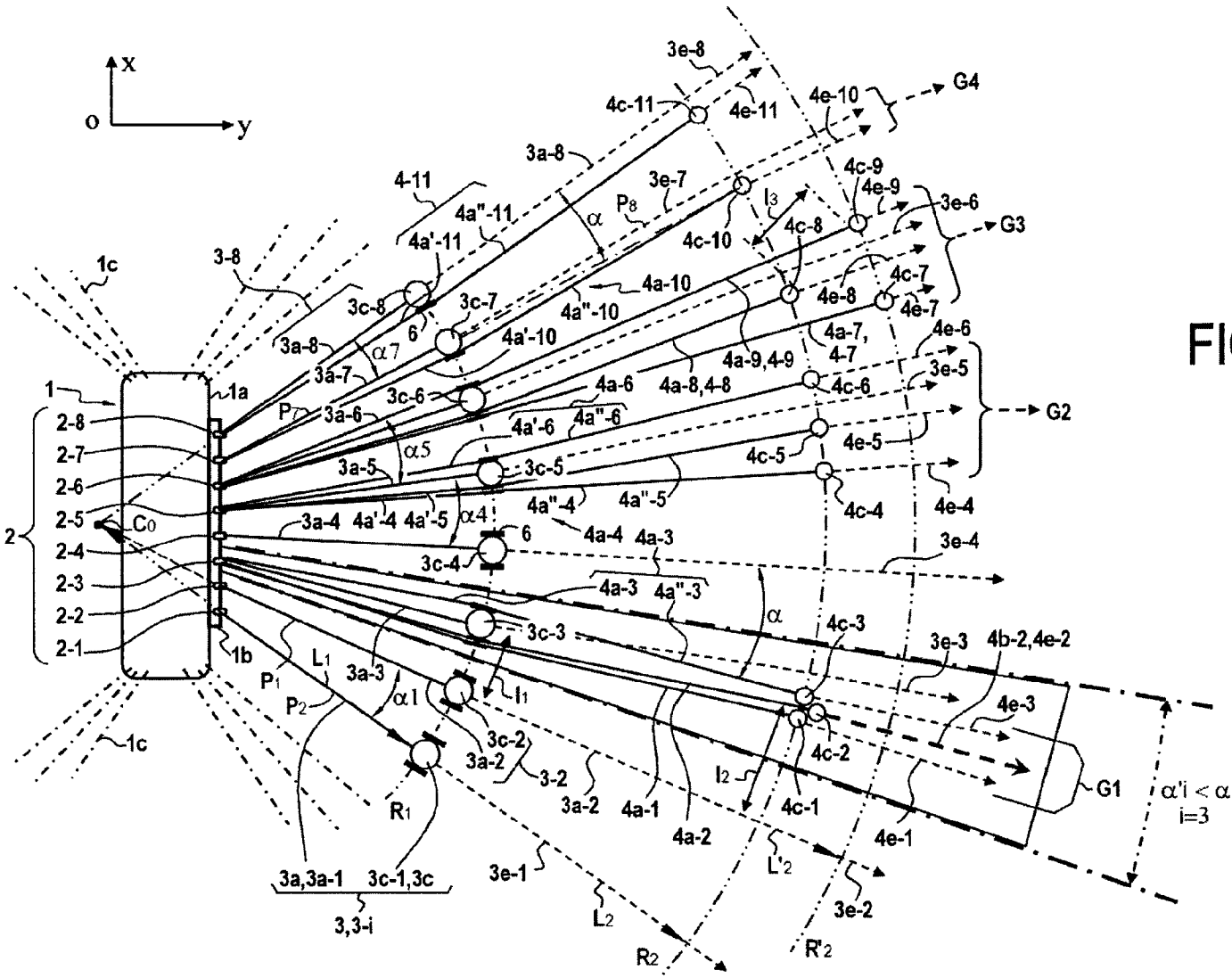
FIG. 1 is a plan view of a fan-shaped bottom-to-surface connection installation of the invention.

FIG. 1 is a plan view of a floating support 1 anchored by twelve anchor lines 1*c* and presenting a structure 1*b* on its side face that is secured to the side 1*a* of said floating support. Said structure 1*b* supports a plurality of connection interfaces 2, 2-1 to 2-8 that have connected thereto a plurality of first flexible pipes 3*a*-1 to 3*a*-8 and second flexible pipes 4*a*-1 to 4*a*-11 forming portions respectively of first and second bottom-to-surface connections 3-1 to 3-8 and 4-1 to 4-11. These pipes are mainly flexible pipes for conveying crude oil, gas, or indeed water for injection into certain wells of the oil field. These pipes may be associated with umbilicals for controlling well heads and other undersea equipment, or indeed electric cables for delivering power, e.g. to undersea pumps or valves.

More precisely, in FIG. 1, there can be seen a bottom-to-surface connection installation comprising a plurality of bottom-to-surface connections 3-*i* with i=1 to k and k=8, 4-*j* with j=1 to m and m=11, arranged in a fan from a common floating support 1 out to a plurality of undersea pipes 3*e*-*i* with i=1 to k, 4*e*-*j* with j=1 to m resting on the sea bottom 12, said bottom-to-surface connections comprising at least:

1) a first number k=8 of first bottom-to-surface connections 3, 3-*i* with i=1 to 8, each said first bottom-to-surface connection forming a first hybrid tower, each hybrid tower comprising:

1a) a first rigid pipe consisting in a first vertical riser 3*b*, 3*b*-*i* with i=1 to k, having its bottom end fastened to a first base 3*d*-*i* where i=1 to k anchored to the sea bottom and connected to a first undersea pipe 3*e*-*i* with i=1 to k resting on the sea bottom, and having its top end 3*b*' tensioned so as to be substantially vertical by a first float 3*c*-*i* with i=1 to k, the float being immersed in the subsurface, preferably at a depth of at least 50 m, the pipe being connected to the float by a chain 5*a*; and 1b) a first diving flexible connection pipe 3*a*, 3*a*-*i* where i=1 to k providing the connection between said floating support and the top end of said first riser, said first flexible pipe being attached at level 2, 2-*i* with i=1 to k of a side 1*a* of said floating support, two attachment points of two successive ones of said first flexible pipe being regularly spaced apart by a common distance £, and two virtual vertical planes $P_i$, $P_{i+1}$ with i=1 to (k−1) respectively containing said two first flexible connection pipes 3*a*-*i*, 3*a*-(i+1) with i=1 to k−1 at rest, the planes being arranged angularly in regular manner relative to one another at a first angle αi with i=1 to k−1 of the same value among the various αi, the various vertical planes Pi intersecting substantially in a common point $C_0$ in a horizontal section plane; and 2) a second number m of second bottom-to-surface connections 4, 4 j with j=1 to m and m=11, referred to as second bottom-to-surface connections, each forming a second hybrid tower comprising:

2a) a second rigid pipe 4*b*, 4*b* j with j=1 to 11 consisting in an upright column comprising a second vertical riser 4*b* 1, 4*b* 2 with its bottom end fastened to a second base 4*d* j anchored to the sea bottom 12 and connected to a second undersea pipe 4*e* j with j=1 to m resting on the sea bottom, and with its top end 4*b*' being tensioned by a second float 4*c*, 4*c* j with j=1 to m that is immersed in the subsurface, preferably at a depth of at least 50 m, and to which the pipe is connected; and 2b) a second flexible connection pipe 4*a*, 4*a*-*j* with j=1 to m providing the connection between said floating support 1 and the top end 4*b*' of said second rigid pipe, each said second flexible pipe passing via a trough 6, 6*a*-6*b*-6*c* fastened to a said first float, thereby defining two portions 4*a*'-j, 4*a*"-j with j=1 to m of second diving flexible pipes respectively on either side of said first float, the attachment point of each said second flexible pipe being juxtaposed against the attachment point of said first flexible pipe in connection with said first float supporting said second flexible pipe.

Said first floats are all spaced apart from one another by a common distance $L'_1$ and they are all situated at equal distance $L_1$ from the point of intersection $C_0$ of the vertical planes Pi of said first flexible pipes attached to the same side of said floating support, thereby forming a first circular row $R_1$ of said first floats.

Nine of said second floats 4*c*-1 to 4*c*-6, 4*c*-8 and 4*c*-10 to 4*c*-11 are situated substantially at a common distance $L_2$ from the point of intersection $C_0$ of the vertical planes Pi of said first flexible pipes attached at 2-3, 2-5, 2-6, 2-7 and 2-8 to the floating support with which said second floats are in connection, thereby forming a second circular row $R_2$ of said second floats.

Three said first floats 3*c*-3, 3*c*-5, and 3*c*-6, each supporting three of said second flexible pipes, passing respectively via three troughs fastened to each of said first floats, i.e.:

for the first float 3*c*-3, the second pipes 4*a*-1, 4*a*-2, and 4*a*-3;

for the first float 3*c*-5, the second pipes 4*a*-4, 4*a*-5, and 4*a*-6; and for the first float 3*c*-6, the second pipes 4*a*-7, 4*a*-8, and 4*a*-9.

Two said second floats 4*c*-7 and 4*c*-9 form a third circular row $R'_2$ of second floats that is further away at a distance $L'_2$ than said second circular row of second floats.

The two portions 4*a*'-j and 4*a*"-j of second flexible pipes in connection with said second floats or said second bases are not necessarily situated in a common vertical plane relative to one another, and the second diving portion of second flexible pipe 4*a*"-j passes via a vertical plane forming an angle that diverges or converges relative to the vertical plane in which the first portion of second flexible pipe 4*a*'-j passes via a trough fastened to the same face of said same first float.

Because the second floats are spaced apart from the floating support by a distance $L_2$, the second floats on a circle $R_2$ are relatively further apart from one another, such that it is possible from a given first float 3*ci* to arrange at least three second pipes ka-j without the neighboring second floats 4*c*-*j* interfering with one another in the event of rough weather.

A said second rigid pipe 4*b*-2 is a catenary type pipe or SCR constituted by the end of a second undersea pipe 4*e*-2 resting on the sea bottom and rising up the subsurface along a catenary curve, essentially following a curve that varies continuously up to a said terminal second float 4*c*-2.

Said terminal second float 4*c*-2 at the top of said second rigid pipe of catenary type 4*b*-2 is secured and rigidly fastened to two of said second floats 4*c*-1 and 4*c*-3 that are in connection with the two vertical risers 4*b*-1 and 4*b*-3. Said second flexible pipes 4*a*-1, 4*a*-2, and 4*a*-3 pass via said first floats 3*c*-3 over a trough 6*a*, 6*b*, 6*c* that is fastened above the trough 6*a* supporting the flexible pipe 4*a*-1, which flexible pipe is at the same level as and on the face opposite to the trough 6*b* of the other two second pipes 4*a*-1 and 4*a*-3.

The various bottom-to-surface connections are installed in a fan configuration along the side 1*a* of the floating support, thus making it possible to increase the number of them because the connection interfaces between said second flexible pipes and said second rigid pipes are further away $L_2$ from the floating support than are the connection interfaces between the first flexible pipes and the first rigid pipes that are situated at a distance $L_1$ from the floating support. This enables each of the bottom-to-surface connections to be at a safe lateral distance from its direct neighbor, e.g. a distance $L'_1$ of at least 40 m for the distance between the first floats. Thus, under the effect of currents, wind, and swell acting on the floating support and also on said bottom-to-surface connections, there are no impacts or interference between the floats of said bottom-to-surface connections, nor between said flexible connection pipes.

By way of illustration, the first connection interface row between said first flexible pipes and said first rigid pipes, and thus also said first bases, lie on a circle $R_1$ situated at a distance $L_1$=350 m from the side of the floating support, whereas the second connection interface row $R_2$ between the second flexible pipes and the second rigid pipes, and also the second bases, lie on a circle $R_2$ that is situated beyond the circle $R_1$, e.g. at 300 m from the circle $R_1$, such that they are at a distance $L_2$=650 m from the floating support.

A plurality of corridors are thus defined for potential lateral movements of the first floats in the event of winds, swell, or current, with the width thereof increasing with increasing distance from the floating support. As shown in said FIG. 1, the axis of the corridor is spaced apart from the axis of a neighboring corridor:

by a length l at the interface support 2*b*-2*c* between the flexible pipes and the floating support 2; and by a length $l_1$ at the first row $R_1$ of said first floats; and by a length $l_2$ at the second row $R_2$ of said second floats.

The axes of said corridors extend in the vertical plane Pi containing the first flexible pipes and two consecutive corridor axes lie in planes Pi and Pi+1 that are spaced apart by an angle αi, with the various angles αi all having the same value in this example, which value is of the order of 5° to 10°. The angle α'i of the angular sector of a corridor is less than or equal to the value of the angles αi between two consecutive corridor axes. The angular movement angle α'i has the same apex $C_0$ as the angle αi between two planes Pi and Pi+1. The angle α'i presents a bisector lying in said plane Pi. The value of α'i depends on the angular movement angles $\gamma_1$ of the first rigid pipes or the first vertical risers 3*bi* relative to their anchor points at the sea bottom in a vertical plane XOZ or XOY, and on the height of said first rigid pipe or vertical riser 3*bi* and/or the depth of water under said first float 3*ci*, for the first float being at a height h of 1000 m to 3500 m above the sea bottom.

In practice, at the above-mentioned distances $L_1$, when using angles $\gamma_1$ of less than 5°, preferably lying in the range 3° to 5°, it is possible to implement first float spacings such that the angles $\alpha i$ present a value lying in the range 5° to 10°.

Some of the second floats 4*c*-7, 4*c*-9 and of the connection interfaces between the second flexible pipes and the second rigid pipes are connected in a third row $R'_2$ similar to the second row $R_2$, but offset a little outwards, so as to increase the distance between two adjacent second floats in order to reach a distance $l_3$ as shown on the second connection group G3 in FIG. 1, thereby further increasing the safety distance against impacts and interference that are to be avoided between the various second floats and the various second flexible pipes.

Figures 2, 2A:
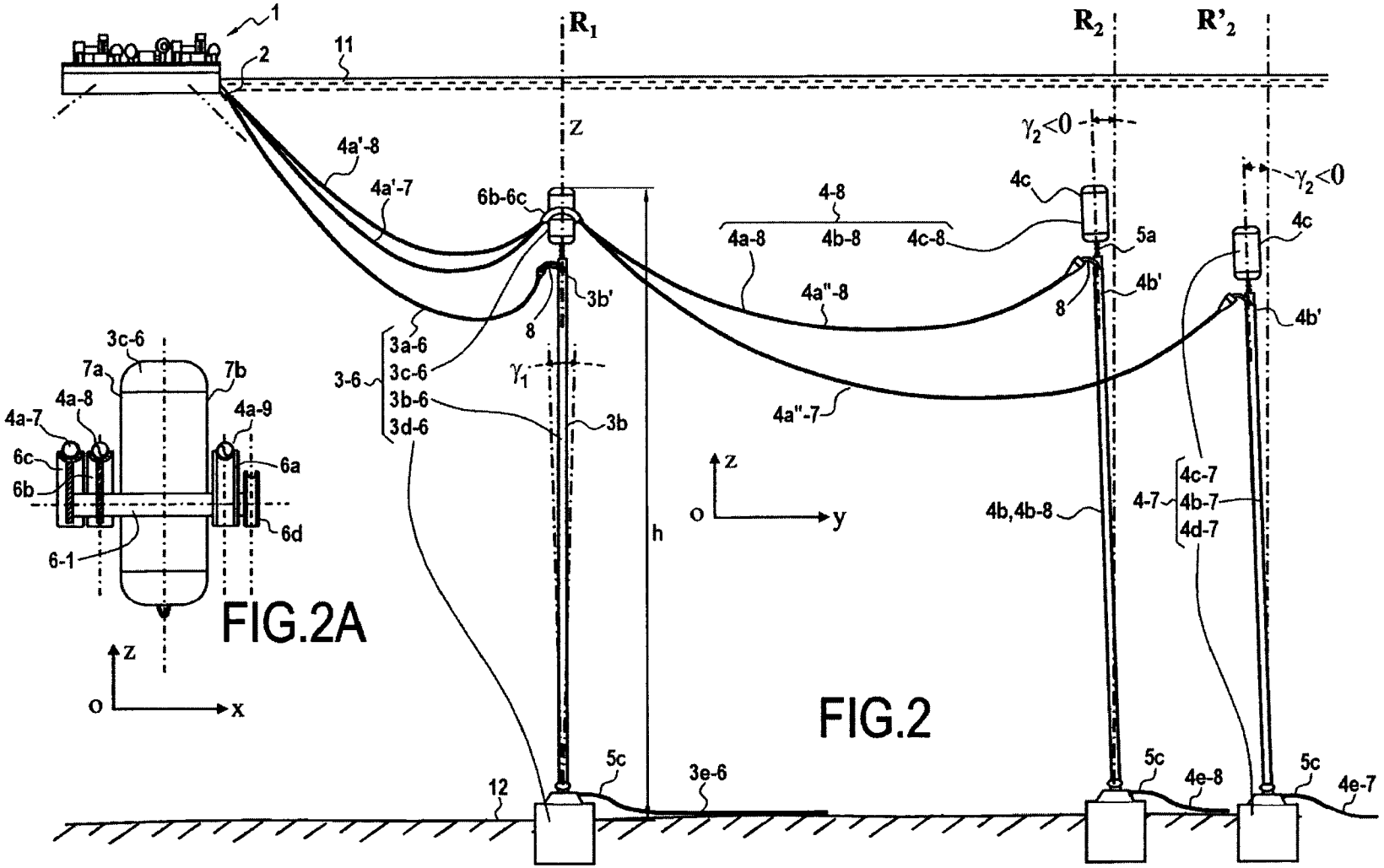
FIG. 2 is a side view of two of the second bottom-to-surface connections of the connection group G3 of second bottom-to-surface connections of FIG. 1.
FIG. 2A is a section view on plane XOZ of a said first float of said first FIG. 2 bottom-to-surface connection showing the passage of three second flexible pipes.

FIG. 2 is a side view showing two of the second connections, namely 4-7 and 4-8 of the second bottom-to-surface connection group G3 of FIG. 1. More precisely, a first bottom-to-surface connection 3-6 is constituted by a rigid rising column 3*b*-6 connected to a first base 3*d*-6, e.g. to a suction anchor, via a flexible mechanical connection capable of taking up the vertical traction forces created by the floats 3*c*-6 connected to the top end of said rising column by means of a chain 5*a*. Connections are made to the rising column 3*b*-6 in known manner, using a swan-neck device 8 at its top edge 3*b*', and at its bottom end to a first undersea pipe 3*e*-6 resting on the sea bottom 12 via an S-shaped junction pipe 5*c*.

As shown in FIG. 2A, which is a side view on axis YY' of the first float 3*c*-6, the float has three main troughs 6*a*-6*b*-6*c* for supporting said second flexible pipes 4*a*-7, 4*a*-8, and 4*a*-9, and a fourth trough 6*d* of smaller size for supporting electric cables or various other umbilicals that are to reach the second row $R_2$. The various troughs 6*a*, 6*b*, 6*c*, and 6*c* are supported by a support structure 6-1. The two second pipes 4*a*-7 and 4*a*-8 shown in FIG. 2 are arranged on the two juxtaposed troughs 6*a*, 6*c* on one face 7*a* of the float, with the second flexible pipes 4*a*-9 (not shown in FIG. 2) being shown in FIG. 2A as passing over a trough 6*b* on the diametrically opposite face 7*b* of the float 3*c*-6.

Figures 3, 3A, 3B:
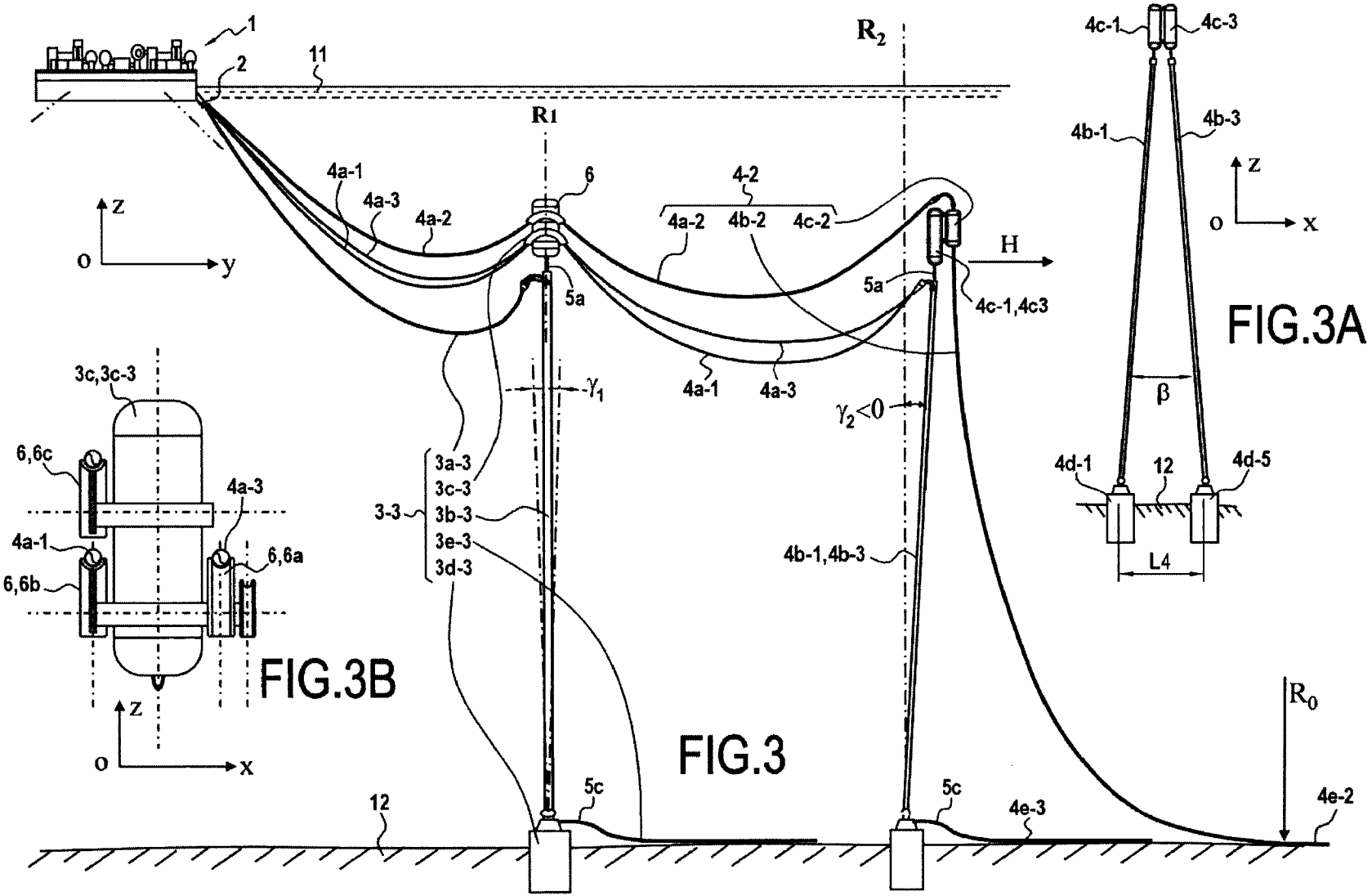
FIG. 3 is a side view in the plane ZOY of the FIG. 1 bottom-to-surface connection group G1.
FIG. 3A is a view in plane XOZ of vertical risers tensioned at their top ends by floats that are rigidly fastened to each other, only one of which is shown in the side view of FIG. 3.
FIG. 3B shows a variant embodiment of the arrangement of troughs for the first float of FIG. 3.

In FIGS. 3, 3A, and 3B, there can be seen a side view of the group G1 of second connections 4-1, 4-2, 4-3 of FIG. 1 in association with the first bottom-to-surface connection 3-3, with three second floats 4*c*-1, 4*c*-2, and 4*c*-3 that are connected together as described above being located therein in the second row $R_2$.

Figure 4:
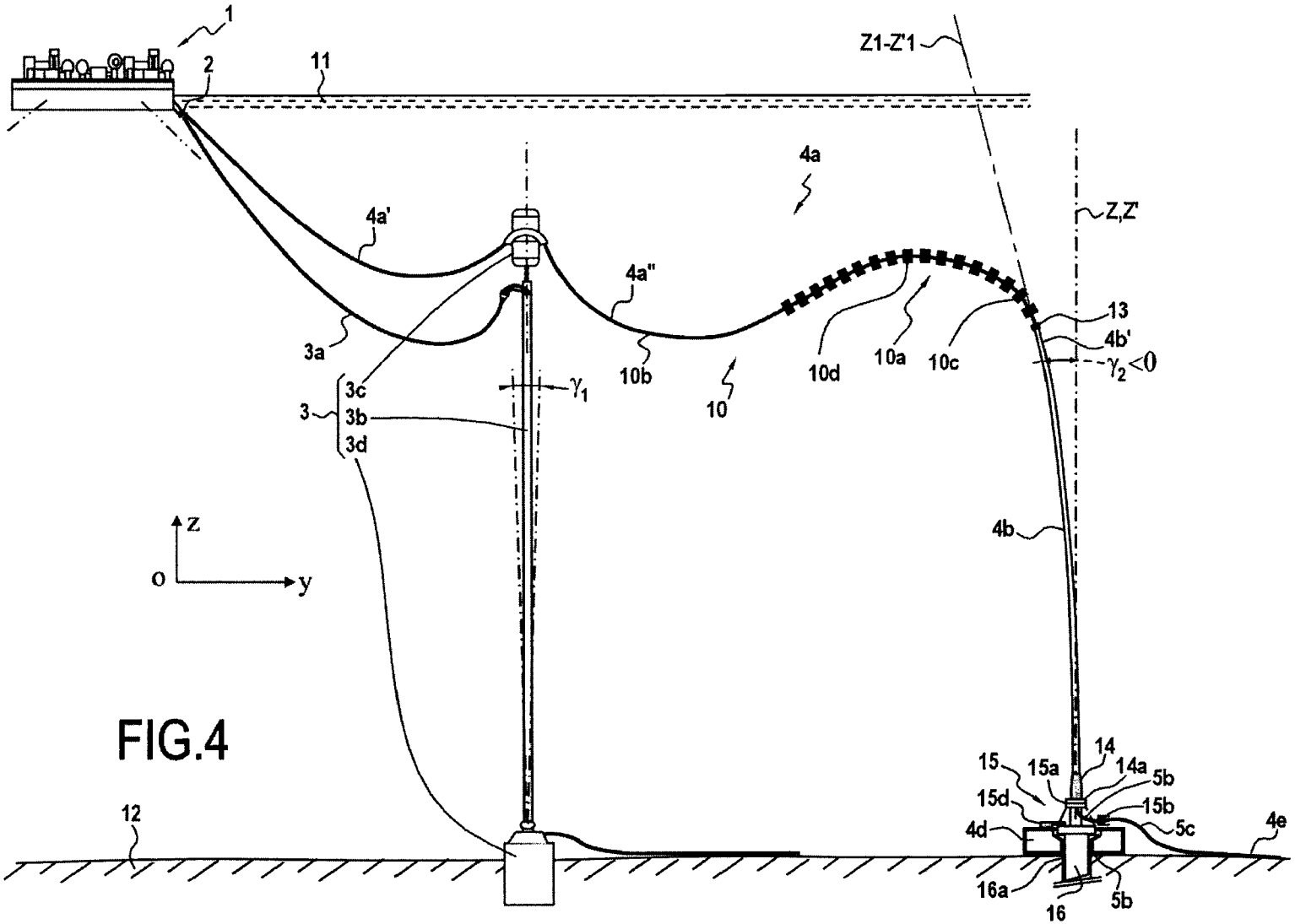
FIG. 4 shows a variant of FIG. 2 in which the second bottom-to-surface connection does not have a said second head float, but has a second buoyancy element consisting in buoyancy distributed along the end portion of the second flexible connection pipe connected to the top portion of the second rigid pipe.

The two risers 4*b*-1, 4*b*-3 in FIG. 3A together form an angle β lying in the range 1° to 10° as a result of their bases 4*d*-1, 4*d*-3 being spaced apart by $L_4$. Thus, in the event of differential expansion due to different temperatures in each of these two vertical pipes 4*b*-1 and 4*b*-3, it is possible there will be deformation of the triangle having the angle at the apex $\beta_1$ and having its base constituted by the line connecting the two bases 4*d*-1 and 4*d*-3. When one of the two risers is cold and the other is hot, the triangle may deform and its apex may move to the right or the left in FIG. 3A. In addition, as shown in FIG. 3, the SCR 4*b*-2 arranged beside the risers 4*b*-1, 4*b*-3 furthest from the FPSO 1 for obvious reasons associated with space constraints gives rise to significant horizontal tension H that tends to move the two second floats 4*c*-1 and 4*c*-3 apart from the FPSO 1 and generate an inclination in the risers 4*b*-1 and 4*b*-3 at a positive angle $\gamma_2$, whereas the inclination $\gamma_2$ of the connections of the second vertical risers in FIGS. 2 and 4 is negative. The first rigid pipes of the first bottom-to-surface connection 3 may take up an inclination that is either positive, or negative, depending on the effects of swell, current, and wind on the floating support and on each of the first floats, which are themselves of considerable dimensions. The configurations of the various component elements of the first bottom-to-surface connections 3 are thus adjusted so as to accommodate the excursions of said first floats and of the top ends of said first rigid pipes within a cone of angle $\gamma_2$, which excursions are preferably less than 5°, and in practice lie in the range 3° to 5°.

FIG. 1 shows the following variant ways of grouping together a plurality of second bottom-to-surface connections:

- in the group G2, the third second floats 4*c*-4, 4*c*-5, and 4*c*-6 are substantially regularly spaced apart from one another over the second row $R_2$ because the second flexible pipe 4*a*-5 is diverted in its second portion 4*a*"-5 after passing over the trough 6 on the first float 3*c*-5. In contrast, the second flexible pipe 4*a*-6 lies substantially in a single plane Pb for both of these portions 4*a*'-6 and 4*a*"-6;
- in the connection group G4, there is shown only one second connection 4-10, and the second portion of the second flexible pipe 4*a*"-10 is deflected after passing over the trough 6 on the first float 3*c*-7 so as to maintain constant spacing relative to the nearest second flexible pipe 4"*a*-9, which second flexible pipe extends radially in the plane Pb.

In the installation as shown in FIG. 1, additional second bottom-to-surface connections may be installed, in particular connection interfaces between the second flexible pipes and the second rigid pipes arranged in the rows $R_2$ or $R'_2$, and by causing second flexible pipes to pass via three troughs of the first floats 3*c*-1, 3*c*-2, 3*c*-4, 3*c*-7, and 3*c*-8.

In the present invention, the first row $R_1$ and the second row $R_2$ are described as being circles centered on $C_0$. However it is clear that the object of the invention is to space the connection interfaces of the bottom-to-surface connections in a given row $R_1$ or $R_2$-$R'_2$ physically apart from one another, so any rectilinear or curvilinear arrangement may be adopted for each of said rows. Likewise, it will be understood that it is possible advantageously to consider additional rows for arranging the second floats.

Finally, it remains within the spirit of the invention to take third bottom-to-surface connection pipes into consideration having the connection interfaces between the third flexible pipes and the third rigid pipes arranged in a row $R_3$ that is further away than $R_2$ and $R'_2$, and under such circumstances the second floats constitute intermediate floats with troughs that support the third flexible connection pipes, which pipes then comprise three portions diving in catenaries, namely:

- a first diving portion between the floating support and the first float;
- a second diving portion between the first float and the second float; and
- a third diving portion between the second float and the third float.

Finally, FIG. 4 shows a variant embodiment in which the second rigid pipe or second vertical riser 4*b* is tensioned, not by a second float, but by a second buoyancy element consisting in a terminal portion 10*a* of the flexible pipe portion extending from the first float 3*c* to the top end 4*b*' of the vertical riser 4*b*.

This embodiment, in which the second buoyancy element is not a float but rather a flexible pipe portion of positive buoyancy, is described in the patent application FR-2 930 587 filed on Apr. 24, 2008 in the name of the Applicant.

More precisely, the portion 10 of the second flexible connection pipe 4*a* that extends from the first float 3*c* to the top end 4*b*' of the vertical riser 4*b* comprises:

- a concave first portion 10*b*, 4*a* extending to a substantially middle point of inflection 10*f*, comprising half of the flexible pipe portion 10, in the form of a pipe in a diving catenary configuration as a result of its negative buoyancy. Beyond the point of inflection 10*f* that is substantially halfway along the flexible pipe portion 10, a convex terminal portion 10*a* extends from the central point of inflection 10*f* to the end 10*c* of the second flexible pipe, presenting positive buoyancy as a result of a plurality of floats 10*d* that are preferably regularly spaced apart along and around the convex terminal portion 10*a* of the flexible pipe.

The rising rigid pipe made of steel, known as a "vertical riser" 4*b* is fitted with buoyancy means (not shown) such as half-shells of syntactic foam that are preferably distributed in uniform manner over all or part of the length of said rigid pipe, and at its bottom end it includes an inertial transition piece 14 that is fitted with a first fastener flange 14*a* at its bottom end. The first fastener flange 14*a* is fastened to a second fastener flange 15*a* forming the top portion of a support and connection device 15, itself anchored to a stake 16 secured to the base 4*d* resting on the sea bottom 12, said support and connection device 15 enabling the bottom end of the riser 4 to be connected to a pipe 4*e* resting on the sea bottom, as explained below.

The flexible pipe portion 10 presents continuous variation of curvature, being initially concave in the portion 10*b* in a diving catenary configuration, and then convex in the terminal portion 10*a* of positive buoyancy with a point of inflection 10*f* between them, thus forming an S-shape lying in a substantially vertical plane.

In operation, and as shown in FIG. 4, when the top portion of the rigid pipe 4*b* is inclined $Z'_1Z'$ at an angle of inclination γ relative to the vertical ZZ', the end 10*c* of the terminal portion 10*a* with positive buoyancy of the flexible pipe 4*a* remains substantially in axial alignment $Z'_1Z'$ with the top end 4*b*' of the rigid pipe 4*b*, and in any event remaining in continuity of curvature therewith. This provides better mechanical strength to the leaktight fastening 13 between the two pipes and makes it possible to avoid implementing a swan-neck device 8 of the kind implemented in the prior art.

The advantage of this flexible pipe is that its diving initial portion 10*b* serves to damp the excursions of the first risers 3*b* and of the floating support 1 so as to stabilize the end 10*c* of the flexible pipe connected to the second rising rigid pipe 4*b*.

The end of the floating terminal portion 10*c* of the flexible pipe carries a first fastener flange element 13 for fastening to the top end of a rigid pipe that extends from the sea bottom where it is restrained by a base 4*d* resting on the sea bottom.

The vertical riser 4*b* is "tensioned" firstly by the buoyancy of the terminal portion 10*a* of the flexible pipe, but secondly and above all by floats that are regularly distributed over at least the top portion 4*b*', and preferably over the entire length of the rigid pipe, in particular in the form of syntactic foam advantageously acting simultaneously as a lagging system and as a buoyancy system. These floats and syntactic foam may be distributed along and around the rigid pipe over its entire length, or preferably over only a fraction of its top portion.

Thus, if the base 4*d* is at a depth of 2500 m, then it may suffice to cover the rigid pipe 4*b* in syntactic foam over a length of 1000 m from its top end, thus enabling syntactic foam to be used that must be capable of withstanding pressure that is less than that which it would have to withstand if it went down to 2500 m, thereby greatly reducing the cost of the syntactic foam compared with syntactic foam capable of withstanding said depth of 2500 m.

The rigid pipe 4*b* of the invention is thus "tensioned" by a said second buoyancy element consisting in the convex terminal portion with positive buoyancy of said flexible pipe, but without making use of a float at the surface or in the subsurface as in the prior art, thereby limiting the effects of current and of swell and as a result greatly reducing the excursion of the high portion of the vertical riser and thus greatly reducing the forces on the bottom of the riser where it is restrained.

The fastener flange system 13 between the top end of the vertical riser 4*b* and the flexible pipe 4*a*, and the fastener flange connection 14*a*, 15*a* between the bottom end of the inertia transition piece 14 and the connection support device 15 provides leaktight connections between the pipes in question.

The base 4*d* resting on the sea bottom supports a first terminal pipe element 5*b* that is bent or curved forming part of said undersea pipe 4*c* resting on the sea bottom. This bent first terminal pipe element 5*b* has at its end a male or female first portion of an automatic connector 15*b* that is moved laterally relative to an orifice 16*a* and stake 16 passing through said base, while being positioned in stationary and determined manner relative to the axis ZZ' of said stake.

The support and connection device 15 supports a second bent rigid pipe element 5*b* having at its top end said second fastener flange 15*a* and at its bottom end a complementary female or male second portion of an automatic connector 15*b*.

The support and connection device 15 is constituted by structural elements supporting said second bent rigid pipe element 5*b*, said rigid structure elements also providing the connection between said second fastener flange 15*a* and a bottom plate 15*b* that supports on its underface a tubular stake 16 referred to as a tubular anchoring insert.

The fastener system at the top end of the rigid pipe 4*b* for fastening with the flexible pipe 4*a*, 10, and the tensioning of said pipe, imparts greater stability to the top end of the rigid pipe 4*b* associated with angular variation γ that does not exceed 5° in operation.

The present invention thus makes it possible to provide rigid retention at the bottom end of the rigid steel pipe 4*b* on the base 4*d* by using a support and connection device 15. For this purpose, the bottom terminal pipe element of the rigid pipe 4*b* has a conical inertia transition piece 14, presenting inertia in cross-section that increases progressively from a value that is substantially identical to the inertia of the riser pipe element 4*b* to which it is connected in the tapering top portion of the transition piece 14, to a value that is three to ten times greater in its bottom portion that is connected to said first fastener flange 14*a*. The rate at which its inertia varies depends essentially on the bending moment that the vertical riser needs to withstand at said transition piece, where said moment is a function of the maximum excursion of the top portion of the rigid steel pipe 4*b*, and thus of the angle γ. In order to make this transition piece 14, use is made of steels having a high elastic limit, and under extreme stress conditions, it may be necessary to fabricate transition pieces 14 out of titanium.

The invention claimed is:

1. An installation of bottom-to-surface connections, the installation comprising a plurality of bottom-to-surface connections arranged in a fan from a common floating support to a plurality of undersea pipes resting on the sea bottom, said plurality of bottom-to-surface connections comprising at least:

1) a first number k of at least two first bottom-to-surface connections, each referred to as a first bottom-to-surface connection and each of the at least two first bottom-to-surface connections forming a first hybrid tower, each first hybrid tower comprising:

1a) a first rigid pipe consisting in a first vertical riser having its bottom end fastened to a first base anchored to the sea bottom and connected to a first undersea pipe resting on the sea bottom, and having its top end tensioned in a substantially vertical manner by a first float that is immersed in the subsurface, to which the first rigid pipe is connected; and 1b) a diving first flexible connection pipe providing connection between said floating support and the top end of said first vertical riser, said diving first flexible connection pipe displaying a catenary curve shape with a lower point lower than either of its attachment points at respectively both of its ends, said diving first flexible connection pipe being attached to said floating support at the level of a side of said floating support, wherein two successive attachment points, of two successive said diving first flexible connection pipes of two said first hybrid towers, are spaced apart from each other on said side of said floating support, and two virtual vertical planes containing respectively two of said successive diving first flexible connection pipes at rest, are arranged angularly relative to each other at a first angle $\alpha i$ with i=1 to k, the various vertical planes Pi of the various said first flexible connection pipes intersecting substantially at a common point $C_0$ in a horizontal section plane; and 2) a second number m of at least one second bottom-to-surface connection, each second bottom-to-surface connection forming a second hybrid tower comprising:

2a) a second rigid pipe consisting in a rising column comprising a second vertical riser or an SCR type catenary second rigid pipe, with the bottom end thereof connected to a second undersea pipe resting on the sea bottom and with its top end tensioned by a second float immersed in the subsurface, to which the second pipe is connected; and 2b) a second flexible connection pipe providing the connection between said floating support and the top end of said second rigid pipe, said second flexible connection pipe passing via a trough fastened to one of said first floats, thereby defining two diving portions of said second flexible pipe on respective sides of said one first float, each of said diving portions of said second flexible pipe displaying a diving catenary curve shape with a lower point, the two diving portions comprising a first diving portion with a first lower point between said floating support and said one first float and a second diving portion with a second lower point between said one first float and said top end of said second rigid pipe, said first diving portion of said second pipe being situated above said diving first flexible connection pipe attached to the top end of a first rigid pipe tensioned by the same first float, the attachment point of each said second flexible pipe to said floating support on said side of said floating support being situated in the proximity of the attachment point of said diving first flexible connection pipe, and with said one first float supporting said second flexible pipe.

2. The installation of bottom-to-surface connections according to claim 1, comprising:

at least two of said second bottom-to-surface connections; and the shortest distance between an attachment point of said one of said flexible pipes on the floating support and the top end of said second rigid pipe to which it is connected is greater than the longest distance between an attachment point of one of said diving first flexible connection pipes on the floating support and the top end of said first rigid pipe to which it is connected.

3. The installation of bottom-to-surface connections according to claim 1, comprising at least two of said second bottom-to-surface connections, wherein each said first float supports at least two of said second flexible connection pipes.

4. The installation of bottom-to-surface connections according to claim 1, wherein said second rigid pipe consists in a second vertical riser having its bottom end fastened to a second base anchored to the sea bottom and connected to said second undersea pipe resting on the sea bottom and having its top end tensioned in substantially vertical manner by said second float immersed in the subsurface, to which the second rigid pipe is connected.

5. The installation of bottom-to-surface connections according to claim 1, wherein:

said first floats are not situated at equal distances from a common flat side of said floating support to which said diving first flexible connection pipes are connected.

6. The installation of bottom-to-surface connections according to claim 4, comprising a plurality of said second rigid pipes with their top ends tensioned by respectively a plurality of said second floats, said plurality of said second floats being situated at substantially the same distance $L_2$ from the point of intersection $C_0$ of said vertical planes Pi of said diving first flexible connection pipes attached to a common side of said floating support and with which said second floats are in connection, thereby forming a second circular row $R_2$ of said second floats.

7. The installation of bottom-to-surface connections according to claim 3, wherein said second floats that are in connection with a common said first float are not all situated at the same distance from said first float, and the various ones of said bases in connection with a common said first float are not all situated at the same distance from the attachment point on the floating support of said corresponding second bottom-to-surface connections.

8. The installation of bottom-to-surface connections according to claim 7, wherein said second floats form at least one second circular row $R_2$ of second floats and a third circular row $R'_2$ of second floats that is further away $L'_2$ than said second circular row of second floats.

9. The installation of bottom-to-surface connections according to claim 3, wherein at least two of said second flexible pipes passing via a common said first float are fastened to troughs arranged at different heights on said common first float.

10. The installation of bottom-to-surface connections according to claim 3, wherein at least two of said second flexible pipes passing via a common said first float are fastened to troughs arranged on opposite faces of said common first float.

11. The installation of bottom-to-surface connections according to claim 1, further including at least an $n^{th}$ bottom-to-surface connection, where n is an integer not less than 3, the installation comprising:

a) an $n^{th}$ rigid pipe consisting in a rising column comprising an $n^{th}$ vertical riser or an $n^{th}$ SCR type catenary rigid pipe having its bottom end connected to an $n^{th}$ undersea pipe resting on the sea bottom and having its top end tensioned by an $n^{th}$ float immersed in the subsurface to which the $n^{th}$ pipe is connected; and b) an $n^{th}$ flexible connection pipe providing the connection between the floating support and the top end of said $n^{th}$ rigid pipe, each said $n^{th}$ flexible pipe passing via n−1 troughs fastened respectively to n−1 intermediate floats immersed in the subsurface, thereby defining n diving portions of said $n^{th}$ flexible pipe, each of said n−1 intermediate floats being a float tensioning at least one $(n-1)^{th}$ rigid pipe of respective $(n-1)^{th}$ bottom-to-surface connection.

12. The installation of bottom-to-surface connections according to claim 1, wherein said second rigid pipe is a catenary type pipe constituted by the end of said second undersea pipe respectively resting on the sea bottom and rising to the subsurface along a catenary curve, essentially a continuously varying curve up to a respective second float, wherein the respective second float is a second terminal float.

13. The installation of bottom-to-surface connections according to claim 1, wherein a second float is a second terminal float and at the top of said second rigid pipe of catenary type is secured to and rigidly fastened to at least one other second float in connection with a respective said second vertical riser, the respective second terminal floats that are rigidly fastened together being in connection with the same said first float.

14. The installation of bottom-to-surface connections according to claim 1, wherein:

one end of said second flexible pipe is directly connected to the top end of said second vertical riser, respectively; and the bottom end of said second vertical riser includes a terminal pipe element forming an inertia transition piece in which the variation of inertia is such that the inertia of said terminal pipe element at its top end is substantially identical to the inertia of the pipe element constituting the main portion of the second vertical riser to which it is connected, said inertia of the terminal pipe element increasing progressively to the bottom end of said inertia transition piece having a first fastener flange enabling the bottom end of said second vertical riser, respectively, to be fastened to and restrained by a support and connection device secured to said second base, anchored to the sea bottom; and a terminal portion of said second flexible pipe, beside its junction with the top end of said second riser, presents positive buoyancy, and at least a top portion of said second vertical riser also presents positive buoyancy, such that the positive buoyancies of said terminal portion of said second flexible pipe and of said top portion of said second vertical riser enable said second riser to be tensioned in a substantially vertical position and enable the end of said terminal portion of said second pipe to be in alignment with or in continuity of curvature with the top portion of said second vertical riser where they are connected together, said positive buoyancy being provided by a plurality of peripheral floats arranged coaxially around the pipe and regularly spaced therealong, and/or by a continuous coating of positive buoyancy material; and said terminal portion of said second flexible pipe presenting positive buoyancy extends over a fraction of the total length of said second flexible pipe, such that the portion of said second pipe that extends between said first float and the top of said second vertical riser, presents an S-shaped configuration, with a portion beside said first float presenting concave curvature in the form of a catenary having a diving catenary configuration, and the remaining terminal portion of said second flexible pipe presenting convex curvature of upside-down catenary shape as a result of its positive buoyancy, the end of said terminal portion of said second flexible pipe, at the top end of said second riser, being situated above and substantially in alignment with the sloping axis $Z_1Z'_1$ of said second riser at its top end.

15. The installation of bottom-to-surface connections according to claim 14, wherein:

said second vertical riser is connected at its bottom end to at least one second undersea pipe, resting on the sea bottom; and said second undersea pipe resting on the sea bottom has a terminal first bent rigid pipe element secured to said second base resting on the sea bottom, and said terminal first bent rigid pipe element is held stationary relative to said second base with, at its end, a first coupling element portion; and said first fastening flange at the bottom end of said inertial transition piece is fastened to a second fastener flange at the end of a second bent rigid pipe element secured to said support and connection device fastened on said second base and supporting, in stationary and rigid manner, said second bent rigid pipe element, the other end of which includes a second coupling element portion complementary to said first coupling element portion and connected thereto when said support and connection device is fastened to said base.

16. The installation of bottom-to-surface connections according to claim 1, wherein k and m are integers from 5 to 50.

17. The installation of bottom-to-surface connections according to claim 1, wherein said first float is immersed at a depth of at least 3 m and said second float is immersed at a depth of at least 50 m.

18. The installation according to claim 5, wherein said first floats are all situated at the same distance $L_1$ from the point of intersection $C_0$ of said vertical planes Pi of said first flexible pipes attached to a common side of said floating support, thereby forming a first circular row $R_1$ of said first floats.

19. The installation of bottom-to-surface connections according to claim 11, wherein said $n^{th}$ rigid pipe, where n is an integer not less than 3, is a catenary type pipe constituted by the end of said $n^{th}$ undersea pipe respectively resting on the sea bottom and rising to the subsurface along a catenary curve, essentially a continuously varying curve up to a respective said $n^{th}$ float, said respective $n^{th}$ float comprising an $n^{th}$ terminal float.

20. The installation of bottom-to-surface connections according to claim 11, wherein said nth float is an nth terminal float and at the top of said $n^{th}$ rigid pipe of catenary type is secured to and rigidly fastened to at least one other said $n^{th}$ float in connection with a respective said $n^{th}$ vertical riser, the respective $n^{th}$ floats that are rigidly fastened together being in connection with the same n−1 said intermediate floats.

21. The installation of bottom-to-surface connections according to claim 11, wherein:

one end of said $n^{th}$ flexible pipe is directly connected to the top end of said $n^{th}$ vertical riser;

the bottom end of said $n^{th}$ vertical riser includes a terminal pipe element forming an inertia transition piece in which the variation of inertia is such that the inertia of said terminal pipe element at its top end is substantially identical to the inertia of the pipe element constituting the main portion of the $n^{th}$ vertical riser to which it is connected, said inertia of the terminal pipe element increasing progressively to the bottom end of said inertia transition piece having a first fastener flange enabling the bottom end of said $n^{th}$ vertical riser, respectively, to be fastened to and restrained by a support and connection device secured to said $n^{th}$ base, anchored to the sea bottom;

a terminal portion of said $n^{th}$ flexible pipe, beside its junction with the top end of said $n^{th}$ riser, presents positive buoyancy, and at least a top portion of said $n^{th}$ vertical riser also presents positive buoyancy, such that the positive buoyancies of said terminal portion of said $n^{th}$ flexible pipe and of said top portion of said $n^{th}$ vertical riser enable said $n^{th}$ riser to be tensioned in a substantially vertical position and enable the end of said terminal portion of said $n^{th}$ pipe to be in alignment with or in continuity of curvature with the top portion of said $n^{th}$ vertical riser where they are connected together, said positive buoyancy being provided by a plurality of peripheral floats arranged coaxially around the pipe and regularly spaced therealong, and/or by a continuous coating of positive buoyancy material; and said terminal portion of said $n^{th}$ flexible pipe presenting positive buoyancy extends over a fraction of the total length of said $n^{th}$ flexible pipe, such that the portion of said $n^{th}$ pipe that extends between said $(n-1)^{th}$ float, and the top of said $n^{th}$ vertical riser, presents an S-shaped configuration, with a portion beside said $(n-1)^{th}$ float presenting concave curvature in the form of a catenary having a diving catenary configuration, and the remaining terminal portion of said second flexible pipe presenting convex curvature of upside-down catenary shape as a result of its positive buoyancy, the end of said terminal portion of said $n^{th}$ flexible pipe, respectively, at the top end of said $n^{th}$ riser, being situated above and substantially in alignment with the sloping axis $Z_1Z'_1$ of said $n^{th}$ riser at its top end.

22. The installation of bottom-to-surface connections according to claim 21, wherein:

said $n^{th}$ vertical riser is connected at its bottom end to at least one $n^{th}$ undersea pipe, resting on the sea bottom; and said $n^{th}$ undersea pipe resting on the sea bottom has a terminal first bent rigid pipe element secured to said $n^{th}$ base resting on the sea bottom, and said terminal first bent rigid pipe element is held stationary relative to said $n^{th}$ base with, at its end, a first coupling element portion; and said first fastening flange at the bottom end of said inertial transition piece is fastened to a second fastener flange at the end of a second bent rigid pipe element secured to said support and connection device fastened on said $n^{th}$ base and supporting, in stationary and rigid manner, said second bent rigid pipe element, the other end of which includes a second coupling element portion complementary to said first coupling element portion and connected thereto when said support and connection device is fastened to said base.

* * * * *